United States Patent [19]

Santa

[11] Patent Number: 4,829,879

[45] Date of Patent: May 16, 1989

[54] RADIAL PISTON DRIVE MOTOR ASSEMBLY WITH EXHAUST PASSAGES IN CYLINDER

[75] Inventor: Jose L. Santa, New South Wales, Australia

[73] Assignee: Joe Santa & Associates Pty. Ltd., New South Wales, Australia

[21] Appl. No.: 46,079

[22] Filed: May 5, 1987

[30] Foreign Application Priority Data

May 5, 1986 [AU] Australia ..... PH5744

[51] Int. Cl.[4] ..... F01B 1/08; F01B 1/12; F01B 7/06

[52] U.S. Cl. ..... 91/493; 91/498; 173/39

[58] Field of Search ..... 91/493, 491, 495, 481, 91/498, 402; 92/68, 169.1, 170, 171; 173/39

[56] References Cited

U.S. PATENT DOCUMENTS

| | | | |
|---|---|---|---|
| 394,684 | 12/1888 | Farmer | 91/202 X |
| 1,778,238 | 10/1930 | Wilsey | 91/493 X |
| 2,320,571 | 6/1943 | Curtis | 91/493 X |
| 3,002,504 | 10/1961 | Taylor | 91/493 X |
| 3,053,194 | 9/1962 | Webster | 92/171 X |
| 3,174,436 | 3/1965 | Wanner | 91/493 X |
| 3,703,125 | 11/1972 | Pauliukonis | 92/170 X |
| 3,977,303 | 8/1976 | Baker | 91/493 |
| 3,979,910 | 9/1976 | Leuenberger et al. | 60/476 |
| 4,050,544 | 9/1977 | Kalyan et al. | 91/491 X |
| 4,316,705 | 2/1982 | Siewert | 92/171 X |
| 4,339,988 | 7/1982 | Steele | 91/493 |
| 4,478,132 | 10/1984 | Braddock | 91/491 X |

*Primary Examiner*—Edward K. Look
*Assistant Examiner*—George Kapsalas
*Attorney, Agent, or Firm*—Jones, Tullar & Cooper

[57] ABSTRACT

An air motor 24 which may be employed in a mine drilling apparatus includes a hollow body 26 formed of a plastic material, and a driven shaft 38 rotatably supported by the body 26 and incorporating a valve assembly 34. The body 26 has opposing pairs of external faces 58 within which are mounted metal cylinder sleeves 29 which receive pistons 30. A cylinder head 31 of plastic material closes each cylinder 29 and a piston rod couples opposing pairs of pistons 30 and engages the shaft 38 so that power may be transmitted to this driven shaft 38.

3 Claims, 5 Drawing Sheets

10

15
15
19
20
WATER IN
Ia
Ia
18
21
AIR IN
23
22
25
13
12
-56-
-55-
16
17
14
24
-57-
11

20
16
21
18
17

RADIAL PISTON DRIVE MOTOR ASSEMBLY WITH EXHAUST PASSAGES IN CYLINDER

BACKGROUND OF THE INVENTION

1. Field of the Invention

The present invention relates to air compressors and motors and more particularly, but not exclusively, to air motors employed in the mining industry.

2. Description of the Prior Art

Generally in the mining industry, each piece of apparatus is provided with its own motor. The motors used by different pieces of apparatus are generally different and accordingly the problems with respect to repairs and spare parts is exacerbated by the number of different motors. Still further, due to the construction of these motors, the pieces of apparatus are generally heavy with the result that these pieces of apparatus require several men to move them.

SUMMARY OF THE INVENTION

It is the object of the present invention to overcome or substantially ameliorate the above disadvantages.

There is disclosed herein an air motor or compressor having a hollow main body formed of plastics material; a shaft rotably supported by the body so as to be rotatable about a fixed axis; a plurality of external faces formed on said body and arranged in opposing parallel pairs, which faces are parallel to said fixed axis; a passage extending through each face so that the passages of opposing faces are aligned in a direction transverse of said fixed axis; a metal cylinder fixed within each passage; a piston reciprocally mounted within each cylinder; a cylinder head closing the radially outer end of each cylinder so as to cooperate therewith in defining a variable volume working space with the associated piston; piston rod means coupling the pistons of opposing cylinders and engaging said shaft so that power is transmitted therebetween; and valve means to coordinate the delivery and exit of a working gas from the working spaces.

BRIEF DESCRIPTION OF THE DRAWINGS

A preferred form of the present invention will now be described by way of example, with reference to the accompanying drawings wherein.

DESCRIPTION OF THE PREFERRED EMBODIMENT

Figures 1, 1A:
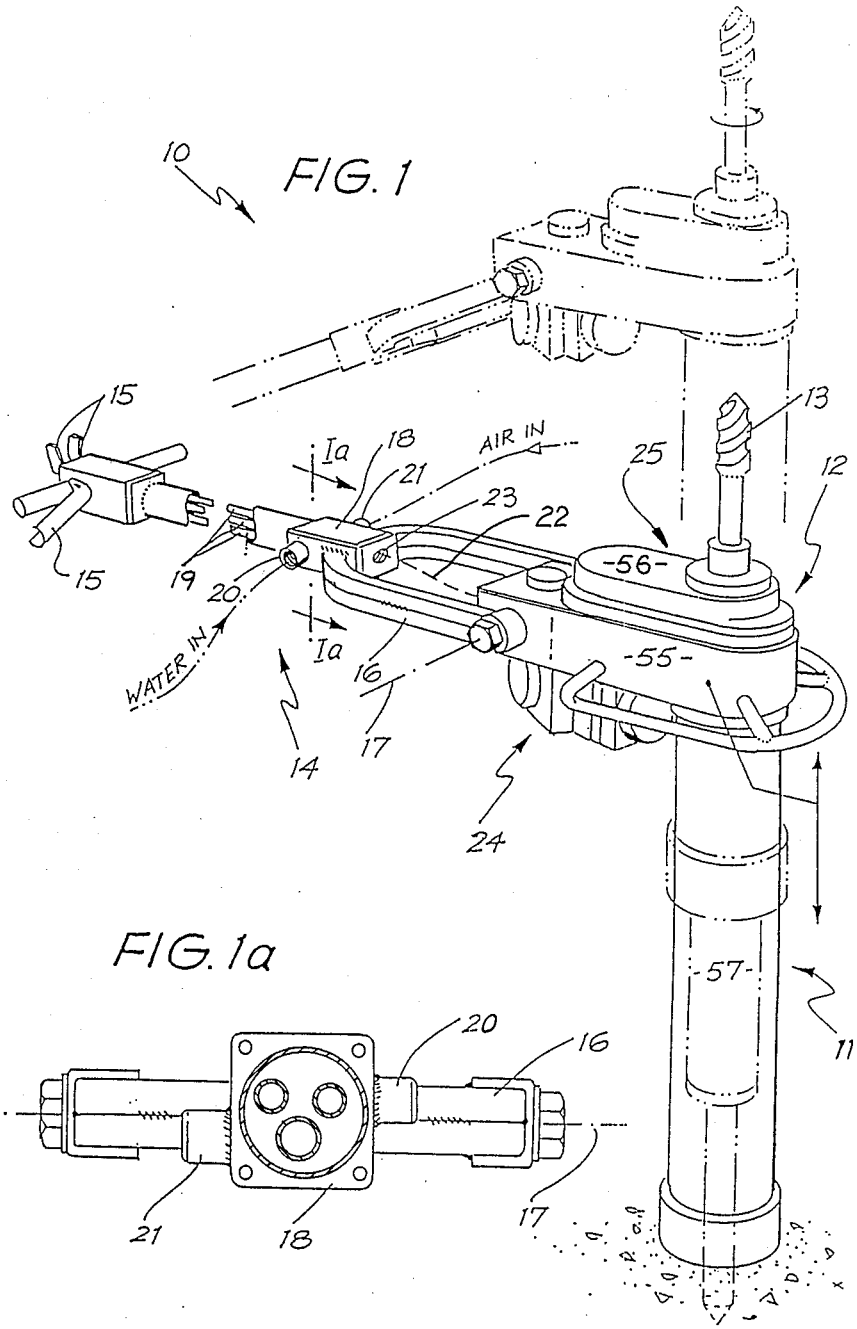
FIG. 1 is a schematic perspective view of a mine drilling apparatus.
FIG. 1*a* is a schematic end elevation of a portion of the apparatus of FIG. 1 sectioned along the line Ia—Ia.
Figures 2A, 2B, 2C:
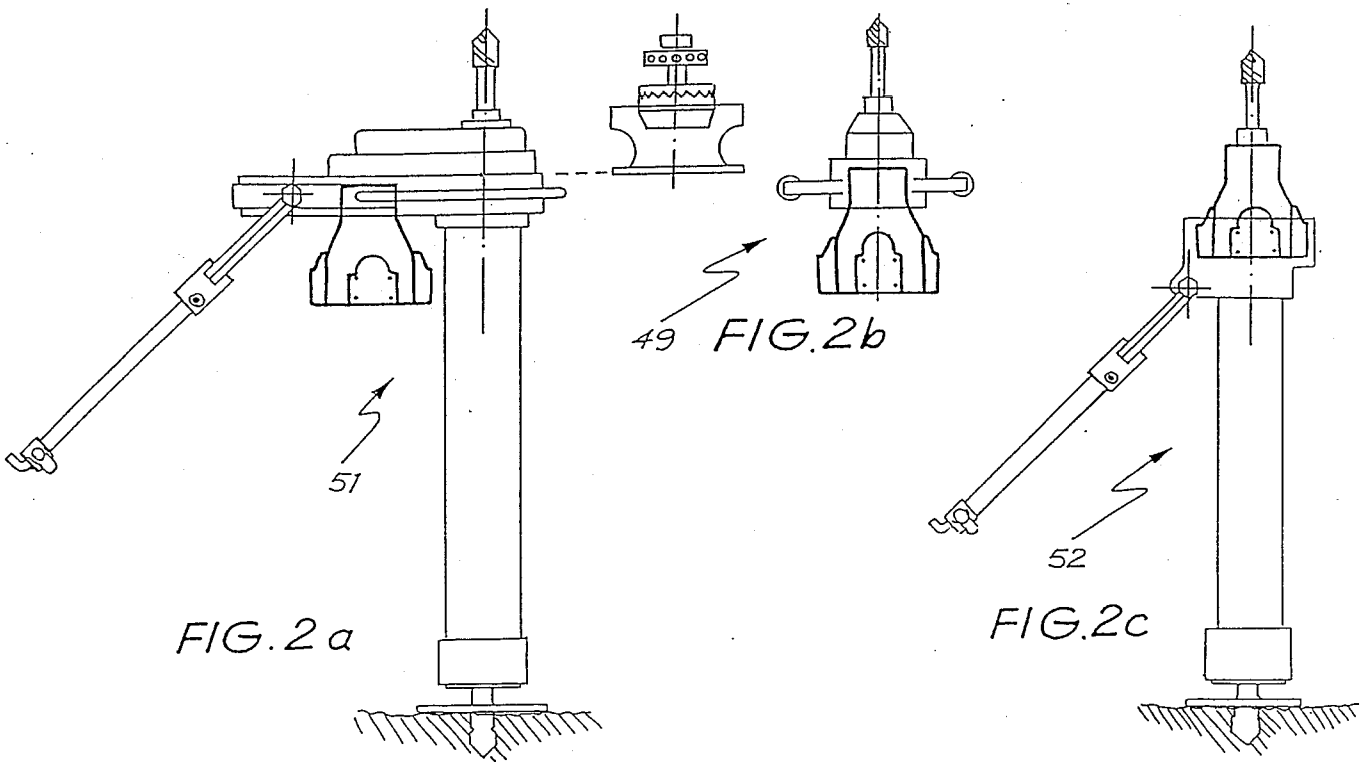
FIGS. 2*a*–2*g* are schematic side elevations of pieces of apparatus employing the motor used in the drilling apparatus of FIG. 1.
Figure 2D:
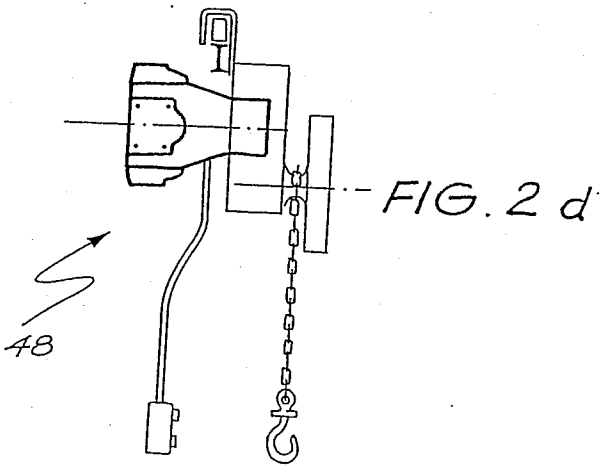
Figure 2G:
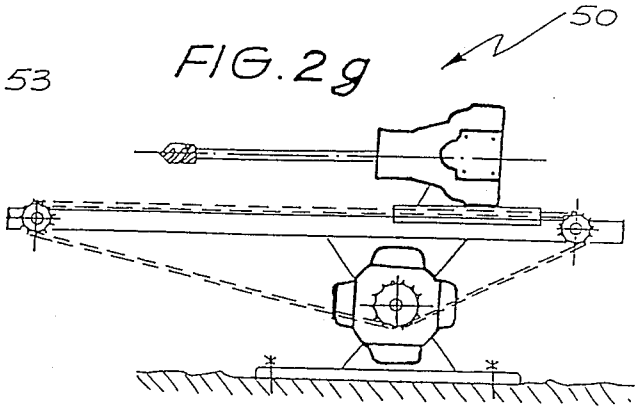
Figure 2F:
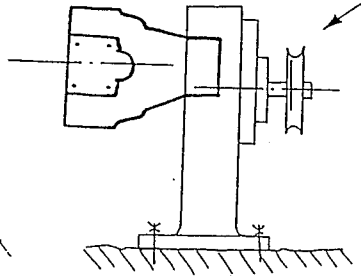
Figure 2E:
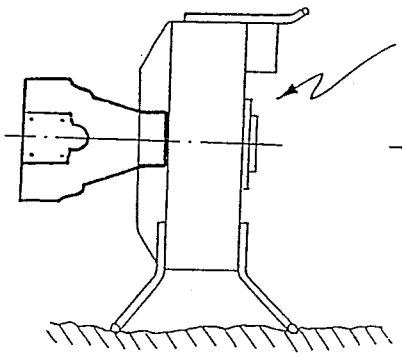

In FIG. 1 there is schematically depicted a mine drilling apparatus 10. The drilling apparatus 10, as an example, could be employed to drill passages to receive mine roof bolts. The apparatus 10 includes a support leg 11 upon which there is mounted a drive unit 12 to rotate a drill bit 13. Extending from the drive unit 12 is a control handle 14 having control levers 15 manipulated by a user of the apparatus 10.

The handle 14 includes a yoke 16 pivotally attached to the drive unit 12 to enable pivoting of the handle 14 about the axis 17. The handle 14 also includes a valve assembly 18 operated by the control levers 15. The control levers 15 operate linkages 19 which extend to the valves within the valve assembly 18. The valve assembly 18 controls the delivery of water and air under pressure to the drive unit 12 and leg 11. More particularly, the valve assembly 18 is provided with a water inlet 20 and an air inlet 21. Water is then delivered from the valve assembly 18 via the yoke 16 to the drive unit 12 so that water for lubrication and cooling purposes may be delivered to the drill bit 13. The yoke 16 may be also employed to deliver air to the leg 11. Additionally, extending from the valve assembly 18 is a conduit 22 joining the passage 23 with the motor 24 . The control levers 15 manipulate the rods 19 to actuate the valves within the valve assembly 18. It should be appreciated that the valves within the valve assembly 18 may be of a simple on-off construction or of a variable resistance type so that the flow rate of water or air may be varied.

Figure 3:
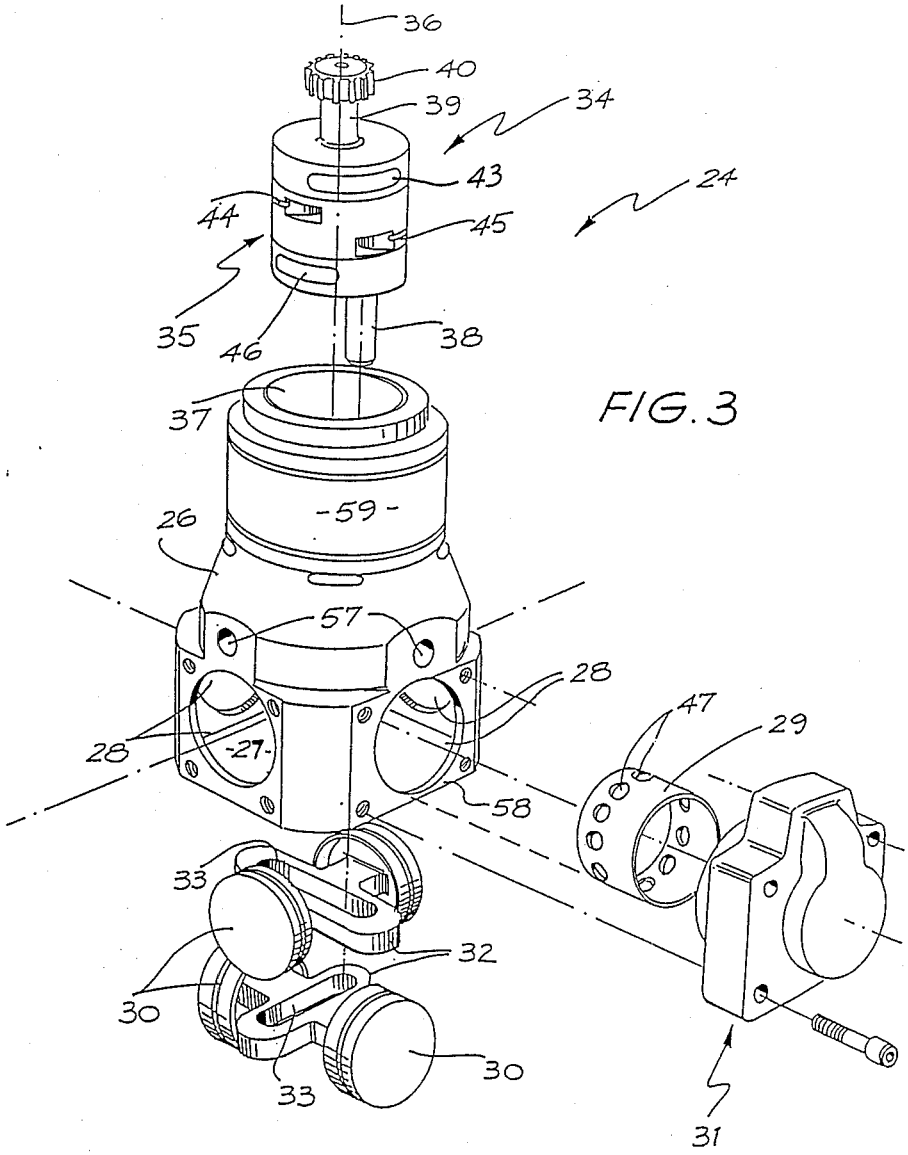
FIG. 3 is a schematic parts exploded view of the motor employed in the apparatus of FIG. 1.
Figure 4:
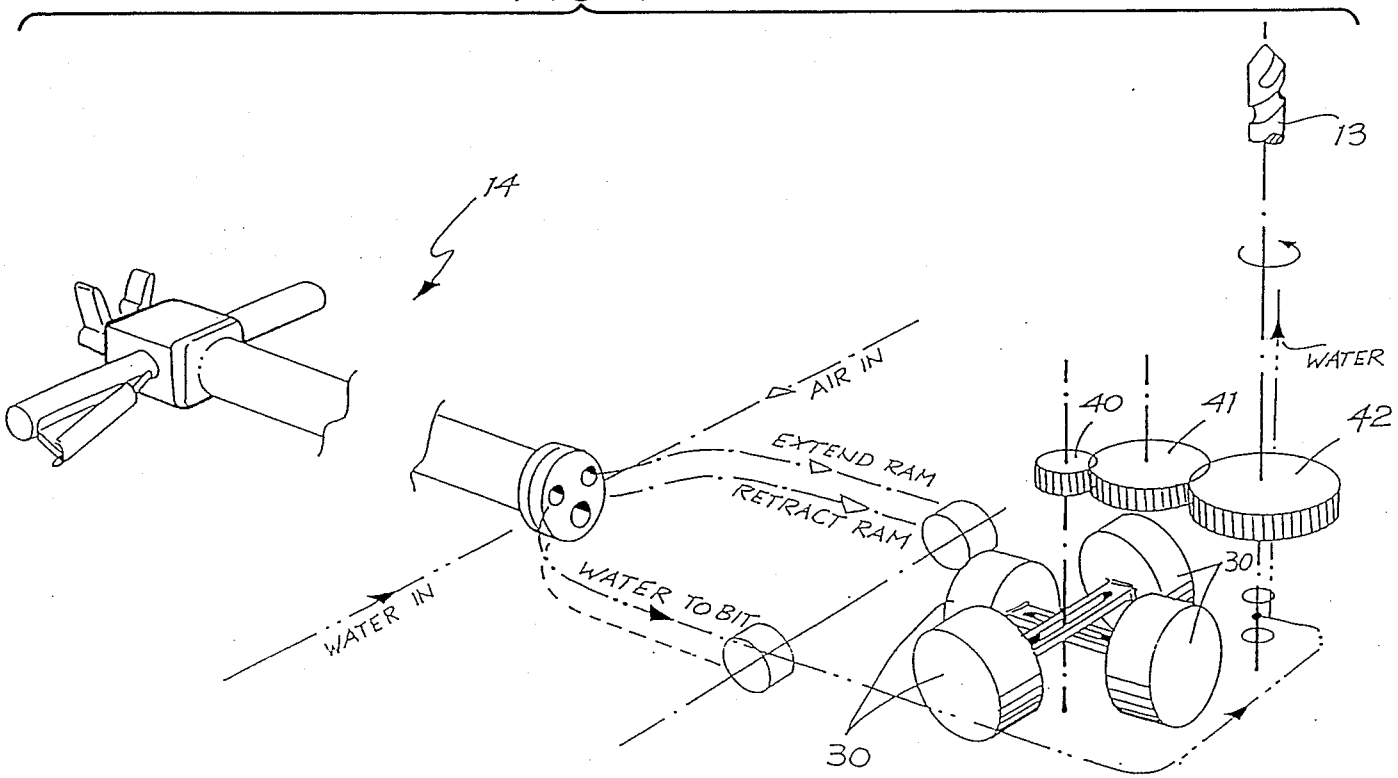
FIG. 4 is a schematic exploded perspective view of the apparatus of FIG. 1.

The drive unit 12 includes the motor 24 and a gearbox 25. The motor 24 is more fully depicted in FIG. 3 and includes a main hollow body 26 formed of plastics material such as nylon. The body 26 is generally hollow so as to define a crankcase 27 from which there extends passages 28. The passages 28 are of circular configuration and are adapted to receive metal cylinders 29. Reciprocally mounted within each cylinder 29 is a piston 30 while closing one end of each cylinder 29 is a head 31. Each head 31 has a cavity within which the cylinder 29 is received. The pistons 30 are arranged in pairs with the pistons of each pair being connected by a piston rod 32. Each piston rod 32 has a slot 33 extending generally transverse to the longitudinal axis of the pistons 30. The cylinders 29 are so arranged that the pistons 30 reciprocate along perpendicular axis. Each piston 30, its associated cylinder 29 and head 31 co-operate to define a variable volume working space to which air under pressure is delivered to cause reciprocation of the associated piston 30. The slots 33 intersect to define an aperture which rotates about a central axis extending normal to the longitudinal axis of both pairs of pistons 30 as well as through the intersection thereof. Rotatably supported by the housing 26 is a valve member 34 which also forms the drive output for the motor 24. The valve member 34 has a main body 35 which is rotated about the axis 36 defined by the passage 37 formed in the body 26. Extending from the valve body 35 is a driven shaft 38 which is received within the recess defined by the intersection of the slots 33. The shaft 38 is fixed to the valve body 35 eccentrically relative to the axis 36. By interreaction of the slots 33, with the shaft 38, the valve body 35 is caused to rotate about the axis 36. Concentric with the axis 36 is a shaft 39 provided with a gear 40 meshingly engaged with a gear 41 (see FIG. 4). The gear 41 is meshingly engaged with a further gear 42 coupled to the drill bit 13.

The valve body 35 is provided with valve passages 43, 44, 45 and 46 which provide for the passage of air under pressure to the working space defined by the pistons 30, their associated cylinders 29 and heads 31. As an example, the passages 44 and 45 could be used as inlet passages for air under pressure, depending on the direction of travel of the motor 24, and the passage 43 and 46 used as exhaust passages. The passages 43 to 46 are selectively aligned with passages 57 extending to the heads 31 for the inlet of air under pressure as well as the ducting of exhaust air from the working space, by being angularly displaced about the valve body 35 relative to the position of the shaft 38. The cylinders 29 are provided with a plurality of passages 47 which allow for the escape of some exhaust air into the interior of the body 26 as the top of the piston passes the passages 47.

The motor 24 may also be used with other pieces of mining equipment as best seen in FIGS. *2a–2g*. For example, the motor 24 could be used to drive a winch 48, a portable hand-borer 49, a horizontal borer 50, a roof bores 51 or 52, a multi-purpose drive assembly 53 or a pump 54.

The body 26 of the motor 24 is formed of plastics material such as nylon. The wearing parts, such as the cylinders 29 would be formed of the appropriate metal. Additionally, other portions of the drilling apparatus 12 may also be formed of plastics material in order to reduce the weight thereof. For example, the gearbox housing 55 and its associated cover 56 may also be formed of plastics material. Additionally, the heads 31 may also be formed of plastics material, such as nylon.

The body 26 is provided with planar faces 58 through which the passages 28 pass. The faces 58 are parallel to the axis 36, and are arranged in parallel opposing pairs. The body also has a cylindrical surface 59 enabling mounting the motor 24 in the appropriate apparatus. The surface 59 is co-axial with respect to the axis 36.

Extending through the surface 59 are a plurality of passages (not specifically shown) to deliver air to, and duct air from the passages 43 to 46.

The leg 11 is provided with a double acting ram 57 to raise and lower the drill bit 13.

I claim:

1. A rotary air motor or compressor comprising:

a hollow main body formed of plastics material;

a shaft rotatably supported by said hollow main body so as to be rotatable about a fixed axis;

a plurality of external faces formed on said hollow main body and arranged in opposing parallel pairs, each of said external faces being parallel to said fixed axis;

a cylinder mounting passage extending through each said external face so that said cylinder mounting passages of opposing ones of said external faces are aligned in a direction transverse of said fixed axis;

a metal cylinder fixed within each of said cylinder mounting passages, each said cylinder having a plurality of exhaust passages located adjacent a radially inner end of each said cylinder;

a piston reciprocally mounted within each said metal cylinder;

a cylinder head of plastic material closing a radially outer end of each said cylinder so as to cooperate with each said cylinder in defining a variable volume working space with the associated piston;

piston rod means coupling said pistons of opposing ones of said cylinders and engaging said shaft so that power is transmitted between said piston rod means and said shaft;

fluid flow passages in said main hollow body and communicating with and extending to said working spaces and through which high and low pressure air passes to and from said working spaces; and, valve means connected to said shaft so as to be driven thereby and including at least a first high pressure valve passage to receive high pressure air, and at least a second low pressure valve passage to receive low pressure air, said valve means being rotatably driven to sequentially connect said first high pressure valve passage and said second low pressure valve passage to said fluid flow passage extending to each said working space to permit the delivery to and exit from said working spaces of said high pressure air and said low pressure air.

2. The motor or compressor of claim 1 wherein said main body is formed with a cylindrical exterior surface, co-axial with respect to said fixed axis, said cylindrical surface providing a mounting means enabling said motor or compressor to be mounted in an apparatus using said motor or compressor.

3. A rotary air motor or compressor comprising:

a hollow main body formed of plastics material;

a shaft rotatably supported by said hollow main body so as to be rotatable about a fixed axis, said shaft including an eccentric shaft portion having an eccentric rotational axis spaced from said fixed axis and parallel thereto;

a plurality of external faces formed on said hollow main body and arranged in opposing parallel pairs, each of said external faces being parallel to said fixed axis;

a cylinder mounting passage extending through each said external face so that said cylinder mounting passages of opposing ones of said external faces are aligned in a direction transverse of said fixed axis;

a metal cylinder fixed within each of said cylinder mounting passages, each said cylinder having a plurality of exhaust passages located adjacent a radially inner end of said said cylinder;

a piston reciprocally mounted within each said metal cylinder;

a cylinder head of plastic material closing a radially outer end of each said cylinder so as to cooperate with each said cylinder in defining a variable volume working space with the associated piston;

piston rod means coupling said pistons of opposing ones of said cylinders and engaging said shaft so that power is transmitted between said piston rod means and said shaft, each said piston rod means including a piston rod having a slot extending transverse of said eccentric axis and engaging said eccentric shaft portion, with each said slot also extending transverse of the longitudinal axis of the associated cylinders;

fluid flow passages in said main hollow body and communicating with and extending to said working spaces and through which high and low pressure air passes to and from said working spaces; and, valve means connected to said shaft so as to be driven thereby and including at least a first high pressure valve passage to receive high pressure air, and at least a second low pressure valve passage to receive low pressure air, said valve means being rotatably driven to sequentially connect said first high pressure valve passage and said second low pressure valve passage to said fluid flow passage extending to each said working space to permit the delivery to and exit from said working spaces of said high pressure air and said low pressure air.

* * * * *